US009903689B2

(12) United States Patent
Marissen et al.

(10) Patent No.: US 9,903,689 B2
(45) **Date of Patent: *Feb. 27, 2018**

(54) MULTILAYERED MATERIAL SHEET AND PROCESS FOR ITS PREPARATION

(75) Inventors: Roelof Marissen, Born (NL); Joseph Arnold Paul Maria Simmelink, Sittard (NL); Reinard Jozef Maria Steeman, Elsloo (NL); Gijsbertus Hendrikus Maria Calis, Hulsberg (NL); Jacobus Johannes Mencke, Maastricht (NL); Jean Hubert Marie Beugels, Landgraaf (NL); David Vanek, Charlotte, NC (US); Johann Van Elburg, Landgraaf (NL); Alexander Volker Peters, Aachen (DE); Steen Tanderup, Maastricht (NL); Marko Dorschu, Beek (NL)

(73) Assignee: DSM IP ASSETS B.V., Heerlen (NL)

( * ) Notice: Subject to any disclaimer, the term of this patent is extended or adjusted under 35 U.S.C. 154(b) by 871 days.

This patent is subject to a terminal disclaimer.

(21) Appl. No.: 12/298,416

(22) PCT Filed: Apr. 26, 2007

(86) PCT No.: PCT/EP2007/003685

§ 371 (c)(1),
(2), (4) Date: Mar. 9, 2009

(87) PCT Pub. No.: WO2007/122010

PCT Pub. Date: Nov. 1, 2007

(65) Prior Publication Data

US 2009/0280708 A1 Nov. 12, 2009

Related U.S. Application Data

(60) Provisional application No. 60/876,544, filed on Dec. 22, 2006.

(30) Foreign Application Priority Data

| | | |
|---|---|---|
| Apr. 26, 2006 | (EP) | 06008600 |
| Jun. 29, 2006 | (EP) | 06013452 |
| Dec. 22, 2006 | (EP) | 06026725 |

(51) Int. Cl.
*B32B 33/00* (2006.01)
*F41H 5/04* (2006.01)

(52) U.S. Cl.
CPC ..... *F41H 5/0471* (2013.01); *F41H 5/04* (2013.01); *F41H 5/0428* (2013.01); *F41H 5/0457* (2013.01); *F41H 5/0478* (2013.01); *F41H 5/0485* (2013.01); *D07B 2201/2003* (2013.01); *D07B 2205/2014* (2013.01); *Y10T 156/10* (2015.01); *Y10T 428/24058* (2015.01); *Y10T 428/24074* (2015.01); *Y10T 428/2495* (2015.01); *Y10T 428/24116* (2015.01); *Y10T 428/24479* (2015.01); *Y10T 428/26* (2015.01); *Y10T 428/265* (2015.01); *Y10T 428/269* (2015.01); *Y10T 428/2913* (2015.01); *Y10T 442/30* (2015.04); *Y10T 442/3504* (2015.04); *Y10T 442/3707* (2015.04); *Y10T 442/3886* (2015.04)

(58) Field of Classification Search
CPC ..... D07B 2205/2014; D07B 2801/10; D07B 2201/2003; F41H 5/04; F41H 5/0428; F41H 5/0457; F41H 5/0471; F41H 5/0478; F41H 5/0485; Y10T 156/10; Y10T 428/24058; Y10T 428/24074; Y10T 428/24116; Y10T 428/2495; Y10T 428/26; Y10T 428/265; Y10T 428/269; Y10T 428/2913; Y10T 442/30; Y10T 442/3504; Y10T 442/3707; Y10T 442/3886
USPC ..... 442/186; 428/113
See application file for complete search history.

(56) References Cited

U.S. PATENT DOCUMENTS

| | | | | |
|---|---|---|---|---|
| 3,924,038 | A | 12/1975 | McArdle et al. | |
| 4,276,348 | A * | 6/1981 | Wu et al. | 428/373 |
| 4,413,110 | A | 11/1983 | Kavesh et al. | |
| 4,836,084 | A | 6/1989 | Vogelesang et al. | |
| 4,931,126 | A | 6/1990 | McCarville et al. | |
| 5,032,338 | A | 7/1991 | Weedon et al. | |
| 5,128,415 | A | 7/1992 | Bastiaansen et al. | |
| 5,175,040 | A | 12/1992 | Harpell et al. | |

(Continued)

FOREIGN PATENT DOCUMENTS

| | | |
|---|---|---|
| EP | 0 187 974 | 7/1986 |
| EP | 0 191 306 | 8/1986 |

(Continued)

OTHER PUBLICATIONS

Nakajima, "Advanced Fibre Spinning Technology," Woodhead Publ. Ltd (1994), ISBN 185573 1827.

(Continued)

*Primary Examiner* — Elizabeth M Cole
(74) *Attorney, Agent, or Firm* — Nixon & Vanderhye P.C.

(57) ABSTRACT

The invention relates to a multilayered material sheet comprising a consolidated stack of unidirectional monolayers of drawn polymer. The draw direction of two subsequent monolayers in the stack differs. Moreover the strength to thickness ratio of at least one monolayer is larger than $4.5.10^{13}$ N/m$^3$. The invention also relates to a ballistic resistant article comprising the multilayered material sheet and to a process for the preparation of the ballistic resistant article.

21 Claims, No Drawings

(56) References Cited

U.S. PATENT DOCUMENTS

| | | | | |
|---|---|---|---|---|
| 5,308,424 | A | 5/1994 | Sasaki et al. | |
| 5,360,656 | A | 11/1994 | Rexfelt et al. | |
| 5,376,426 | A | 12/1994 | Harpell et al. | |
| 5,736,244 | A | 4/1998 | Kavesh et al. | |
| 6,183,834 | B1 * | 2/2001 | van der Loo | B29C 70/30 264/241 |
| 6,238,768 | B1 | 5/2001 | Van De Groot | |
| 6,448,359 | B1 | 9/2002 | Kavesh | |
| 2002/0124900 | A1 | 9/2002 | Khokar | |
| 2004/0086729 | A1 | 5/2004 | Nguyen et al. | |
| 2005/0089677 | A1 | 4/2005 | Marissen et al. | |
| 2006/0051564 | A1 | 3/2006 | Jacobs et al. | |
| 2006/0069185 | A1 | 3/2006 | He et al. | |
| 2006/0210749 | A1 * | 9/2006 | Geva et al. | 428/36.1 |
| 2006/0252325 | A1 | 11/2006 | Matsumura et al. | |
| 2007/0293109 | A1 | 12/2007 | Bhatnagar et al. | |

FOREIGN PATENT DOCUMENTS

| | | |
|---|---|---|
| EP | 0 205 960 | 12/1986 |
| EP | 0 269 151 | 6/1988 |
| EP | 0 488 465 | 6/1992 |
| EP | 0 533 239 | 3/1993 |
| EP | 0 683 374 | 11/1995 |
| EP | 0 733 460 | 9/1996 |
| EP | 1 170 925 | 1/2002 |
| EP | 1 574 811 | 9/2005 |
| EP | 1 627 719 | 2/2006 |
| GB | 2 042 414 | 9/1980 |
| GB | 2 051 667 | 1/1981 |
| JP | 2-504549 | 12/1990 |
| JP | 4-222398 | 8/1992 |
| JP | 6-10233 | 1/1994 |
| JP | 07-504859 | 6/1995 |
| JP | 7-198299 | 8/1995 |
| JP | 8-47994 | 2/1996 |
| JP | 08047994 A * | 2/1996 |
| JP | 9-85865 | 3/1997 |
| JP | 2000-514543 | 10/2000 |
| JP | 2003-27483 | 1/2003 |
| JP | 2006-504925 | 2/2006 |
| KR | 10-2004-0013881 | 2/2004 |
| KR | 10-2007-0065940 | 6/2007 |
| WO | 88/03184 | 5/1988 |
| WO | 93/20271 | 10/1993 |
| WO | 94-19660 | 9/1994 |
| WO | 97/00766 | 1/1997 |
| WO | 00/42246 | 7/2000 |
| WO | 00/48821 | 8/2000 |
| WO | 01/59395 | 8/2001 |
| WO | 01/73173 | 10/2001 |
| WO | 2004-028803 | 4/2004 |
| WO | 2004/033196 | 4/2004 |
| WO | 2005/065910 | 7/2005 |
| WO | 2005/066400 | 7/2005 |
| WO | 2005/066401 | 7/2005 |
| WO | 2005-066577 | 7/2005 |
| WO | 2006/002977 | 1/2006 |
| WO | 2006/073743 | 7/2006 |
| WO | 2007/003334 | 1/2007 |

OTHER PUBLICATIONS

International Search Report for PCT/EP2007/003685, dated Dec. 27, 2007.

* cited by examiner

MULTILAYERED MATERIAL SHEET AND PROCESS FOR ITS PREPARATION

This application is the U.S. national phase of International Application No. PCT/EP2007/003685, filed 26 Apr. 2007, which designated the U.S. and claims priority to Europe Application No(s). 06008600.6, filed 26 Apr. 2006, 06013452.5, filed 29 Jun. 2006, 06026725.9, filed 22 Dec. 2006 and U.S. Application No. 60/876,544 filed 22 Dec. 2006, the entire contents of each of which are hereby incorporated by reference.

The invention relates to a multilayered material sheet comprising a consolidated stack of unidirectional monolayers of drawn polymer, and to a process for its preparation. The invention also relates to a ballistic resistant article comprising the multilayered material sheet.

A multilayered material sheet comprising a consolidated stack of unidirectional monolayers of drawn ultra high molecular weight polyethylene is known from EP 1627719 A1. This publication discloses a multilayered material sheet comprising a plurality of unidirectional monolayers consisting essentially of ultra high molecular weight polyethylene and essentially devoid of bonding matrices, whereby the draw direction of two subsequent monolayers in the stack differs. The disclosed thickness for the monolayers of the multilayered material sheet is between 30-120 μm, with a preferred range of 50-100 μm.

The multilayered material sheet according to EP 1627719 A1 uses ultra high molecular weight polyethylene, essentially devoid of bonding matrices. This feature is necessary in order to obtain the desired antiballistic properties. Although the multilayered material sheet according to EP 1627719 A1 shows a satisfactory ballistic performance, this performance can be improved further.

The object of the present invention is to provide a multilayered material sheet having improved antiballistic properties when compared to the known material.

This object is achieved according to the invention by providing a multilayered material sheet comprising a consolidated stack of unidirectional monolayers of drawn polymer, whereby the draw direction of two subsequent monolayers in the stack differs, and whereby the strength to thickness ratio of at least one monolayer is larger than $4.10^{13}$ N/m$^3$. It has surprisingly been found that this particular combination of features yields an improved antiballistic performance over the known multilayered material sheet. More in particular, when the antiballistic performance of the multilayered material sheet according to EP 1627719 A1 is scaled at 100%, antiballistic performance of more than 130% has been obtained with the multilayered material sheet according to the invention. An additional advantage of the material sheet according to the invention is that it is no longer required to use ultra high molecular weight polyethylene essentially devoid of bonding matrices in order to obtain the desired level of antiballistic properties.

A preferred multilayered material sheet according to the invention is characterized in that the strength to thickness ratio of at least one monolayer is larger than $7.10^{13}$ N/m$^3$, an even more preferred multilayered material sheet in that the strength to thickness ratio of at least one monolayer is larger than $10^{14}$ N/m$^3$, and a most preferred multilayered material sheet in that the strength to thickness ratio of at least one monolayer is larger than $1.4.10^{14}$ N/m$^3$.

Although it is not necessary according to the invention that all monolayers have the claimed ranges for thickness and strength, a multilayered material sheet wherein all monolayers have the claimed ranges for thickness and strength is particularly preferred.

In the context of the present invention, the term "unidirectional monolayer" refers to a layer of a fibrous network of unidirectionally oriented reinforcing fibers and optionally a binder that basically holds the reinforcing fibers together. The term "unidirectionally oriented reinforcing fibers" refers to reinforcing fibers in one plane that are essentially oriented in parallel. "Reinforcing fiber" here means an elongate body whose length dimension is greater than the transverse dimensions of width and thickness. The term "reinforcing fiber" includes a monofilament, a multifilament yarn, a tape, a strip, a thread, a staple fiber yarn and other elongate objects having a regular or irregular cross-section. Any natural or synthetic fiber may in principle be used as reinforcing fiber. Use may be made of for instance metal fibers, semimetal fibers, inorganic fibers, organic fibers or mixtures thereof. For application of the fibers in ballistic-resistant moulded articles it is essential that the fibers be ballistically effective, which, more specifically, requires that they have a high tensile strength, a high tensile modulus and/or high energy absorption. Such fibers are in the context of this application also referred to as anti-ballistic fibers.

In a preferred embodiment, the reinforcing fiber is a tape. The width of the tapes preferably is more than 2 mm, more preferably more than 5 mm and most preferably more than 30, 50, 75 or 100 mm. The areal density of the tapes or monolayers can be varied over a large range, for instance between 3 and 200 g/m$^2$. Preferred areal density is between 5 and 120 g/m$^2$, more preferred between 10 and 80 g/m$^2$ and most preferred between 15 and 60 g/m$^2$. For UHMWPE, the areal density is preferably less than 50 g/m$^2$ and more preferably less than 29 g/m$^2$ or 25 g/m$^2$.

It is preferred for the reinforcing fibers in the monolayer of the invention to have a tensile strength of at least about 1.2 GPa, more preferred at least about 1.5 GPa, even more preferred at least about 2.5 GPa, and most preferred at least about 4 GPa. It is preferred for the reinforcing fibers in the monolayer of the invention to have a tensile modulus of at least 40 GPa. These reinforcing fibers may be inorganic or organic reinforcing fibers. Suitable inorganic reinforcing fibers are, for example, glass fibers, carbon fibers and ceramic fibers. Suitable-organic reinforcing fibers with such a high tensile strength are, for example, aromatic polyamide fibers (so-called aramid fibers), especially poly(p-phenylene teraphthalamide), liquid crystalline polymer and ladder-like polymer fibers such as polybenzimidazoles or polybenzoxazoles, esp. poly(1,4-phenylene-2,6-benzobisoxazole) (PBO), or poly(2,6-diimidazo[4,5-b4',5'-e]pyridinylene-1,4-(2,5-dihydroxy)phenylene) (PIPD; also referred to as M5) and fibers of, for example, polyolefins, polyvinyl alcohol, and polyacrylonitrile which are highly oriented, such as obtained, for example, by a gel spinning process. The reinforcing fibers preferably have a tensile strength of at least 2 GPa, more preferably at least 2.5 GPa or most preferably at least 3 GPa. The advantage of these fibers is that they have very high tensile strength, so that they are in particular very suitable for use in lightweight ballistic-resistant articles.

Suitable polyolefins are in particular homopolymers and copolymers of ethylene and propylene, which may also contain small quantities of one or more other polymers, in particular other alkene-1-polymers.

Particularly good results are obtained if linear polyethylene (PE) is selected as the polyolefin. Linear polyethylene is herein understood to mean polyethylene with less than 1 side chain per 100 C atoms, and preferably with less than 1 side chain per 300 C atoms; a side chain or branch generally containing at least 10 C atoms. The linear polyethylene may further contain up to 5 mol % of one or more other alkenes that are copolymerisable therewith, such as propene, butene, pentene, 4-methylpentene, octene. Preferably, the linear polyethylene is of high molar mass with an intrinsic viscosity (IV, as determined on solutions in decalin at 135° C.) of at least 4 dl/g; more preferably of at least 8 dl/g. Such polyethylene is also referred to as ultrahigh molar mass polyethylene. Intrinsic viscosity is a measure for molecular weight that can more easily be determined than actual molar mass parameters like Mn and Mw. There are several empirical relations between IV and Mw, but such relation is highly dependent on molecular weight distribution. Based on the equation $Mw=5.37\times10^4$ [IV] 1.37 (see EP 0504954 A1) an IV of 4 or 8 dl/g would be equivalent to Mw of about 360 or 930 kg/mol, respectively.

High performance polyethylene (HPPE) fibers consisting of polyethylene filaments that have been prepared by a gel spinning process, such as described, for example, in GB 2042414 A or WO 01/73173, are preferably used as (anti ballistic) reinforcing fiber. This results in a very good anti-ballistic performance per unit of weight. A gel spinning process essentially consists of preparing a solution of a linear polyethylene with a high intrinsic viscosity, spinning the solution into filaments at a temperature above the dissolving temperature, cooling down the filaments to below the gelling temperature, such that gelling occurs, and stretching the filaments before, during or after the removal of the solvent.

The term binder refers to a material that binds or holds the reinforcing fibers together in the sheet comprising monolayers of unidirectionally oriented reinforcing fibers and a binder, the binder may enclose the reinforcing fibers in their entirety or in part, such that the structure of the monolayer is retained during handling and manufacturing of preformed sheets. The binder may be applied in various forms and ways; for example as a film (by melting hereof at least partially covering the anti ballistic fibers), as a transverse bonding strip or as transverse fibers (transverse with respect to unidirectional fibers), or by impregnating and/or embedding the fibers with a matrix material, e.g. with a polymer melt, a solution or a dispersion of a polymeric material in a liquid. Preferably, matrix material is homogeneously distributed over the entire surface of the monolayer, whereas a bonding strip or bonding fibers may be applied locally. Suitable binders are described in e.g. EP 0191306 B1, EP 1170925 A1, EP 0683374 B1 and EP 1144740 A1.

In a preferred embodiment, the binder is a polymeric matrix material, and may be a thermosetting material or a thermoplastic material, or mixtures of the two. The elongation at break of the matrix material is preferably greater than the elongation of the fibers. The binder preferably has an elongation of 2 to 600%, more preferably an elongation of 4 to 500%. Suitable thermosetting and thermoplastic matrix materials are enumerated in, for example, WO 91/12136 A1 (pages 15-21). In the case the matrix material is a thermosetting polymer vinyl esters, unsaturated polyesters, epoxies or phenol resins are preferably selected as matrix material. In the case the matrix material is a thermoplastic polymer polyurethanes, polyvinyls, polyacrylics, polyolefins or thermoplastic elastomeric block copolymers such as polyisopropene-polyethylene-butylene-polystyrene or polystyrene-polyisoprene-polystyrene block copolymers are preferably selected as matrix material. Preferably the binder consists of a thermoplastic polymer, which binder preferably completely coats the individual filaments of said reinforcing fibers in a monolayer, and which binder has a tensile modulus (determined in accordance with ASTM D638, at 25° C.) of at least 250 MPa, more preferably of at least 400 MPa. Such a binder results in high flexibility of a sheet comprising a monolayer, and of a high enough stiffness in a consolidated stack.

Preferably, the amount of binder in the monolayer is at most 30 mass %, more preferably at most 25, 20, 15, 10 or even at most 5 mass %. This results in the best ballistic performance.

According to the invention, the "unidirectional monolayers" also refer to oriented tapes or films. With unidirectional tapes and monolayers is meant in the context of this application tapes and monolayers which show a preferred orientation of the polymer chains in one direction, i.e. in the direction of drawing. Such tapes and monolayers may be produced by drawing, preferably by uniaxial drawing, and will exhibit anisotropic mechanical properties.

The multilayered material sheet of the invention preferably comprises an ultra high molecular weight polyolefine, and in particular an ultra high molecular weight polyethylene. The ultra high molecular weight polyethylene may be linear or branched, although preferably linear polyethylene is used. Linear polyethylene is herein understood to mean polyethylene with less than 1 side chain per 100 carbon atoms, and preferably with less than 1 side chain per 300 carbon atoms; a side chain or branch generally containing at least 10 carbon atoms. Side chains may suitably be measured by FTIR on a 2 mm thick compression moulded film, as mentioned in e.g. EP 0269151. The linear polyethylene may further contain up to 5 mol % of one or more other alkenes that are copolymerisable therewith, such as propene, butene, pentene, 4-methylpentene, octene. Preferably, the linear polyethylene is of high molar mass with an intrinsic viscosity (IV, as determined on solutions in decalin at 135° C.) of at least 4 dl/g; more preferably of at least 8 dl/g, most preferably of at least 10 dl/g. Such polyethylene is also referred to as ultra high molecular weight polyethylene. Intrinsic viscosity is a measure for molecular weight that can more easily be determined than actual molar mass parameters like Mn and Mw. A polyethylene film of this type yields particularly good antiballistic properties.

The tapes according to the invention may be prepared in the form of films. A preferred process for the formation of such films or tapes comprises feeding a polymeric powder between a combination of endless belts, compression-moulding the polymeric powder at a temperature below the melting point thereof and rolling the resultant compression-moulded polymer followed by drawing. Such a process is for instance described in EP 0 733 460 A2, which is incorporated herein by reference. If desired, prior to feeding and compression-moulding the polymer powder, the polymer powder may be mixed with a suitable liquid organic compound having a boiling point higher than the melting point of said polymer. Compression moulding may also be carried out by temporarily retaining the polymer powder between the endless belts while conveying them. This may for instance be done by providing pressing platens and/or rollers in connection with the endless belts. Preferably UHMWPE is used in this process. This UHMWPE needs to be drawable in the solid state.

Another preferred process for the formation of films comprises feeding a polymer to an extruder, extruding a film at a temperature above the melting point thereof and drawing the extruded polymer film. If desired, prior to feeding the polymer to the extruder, the polymer may be mixed with a suitable liquid organic compound, for instance to form a gel, such as is preferably the case when using ultra high molecular weight polyethylene.

Preferably the polyethylene films are prepared by such a gel process. A suitable gel spinning process is described in for example GB-A-2042414, GB-A-2051667, EP 0205960 A and WO 01/73173 A1, and in "Advanced Fiber Spinning Technology", Ed. T. Nakajima, Woodhead Publ. Ltd (1994), ISBN 185573 182 7. In short, the gel spinning process comprises preparing a solution of a polyolefin of high intrinsic viscosity, extruding the solution into a film at a temperature above the dissolving temperature, cooling down the film below the gelling temperature, thereby at least partly gelling the film, and drawing the film before, during and/or after at least partial removal of the solvent.

Advantageously, it has been found that the preparation of polyethylene tape or films by a gel process more readily produces tape or film that has improved anti-ballistic properties. In one embodiment of the present invention, there is provided a method of preparing a polyethylene tape with a high strength to thickness ratio comprising: extruding solution of polyethylene having an intrinsic viscosity (measured in decalin at 135° C.) between about 4 dl/g and 40 dl/g through an opening; stretching the fluid product above the temperature at which a gel will form; quenching the fluid product in a quench bath consisting of an immiscible liquid to form a gel product; stretching the gel product; removing the solvent from the gel product and, stretching the gel product, the total stretch ratio being sufficient to produce a polyethylene tape characterized by a tensile strength to thickness ratio of at least $4.5\times10^{13}$ N/m$^3$. Preferably, the tensile strength to thickness ratio is at least $1\times10^{14}$ N/m$^3$, $1.4\times10^{14}$ N/m$^3$, $1.6\times10^{14}$ N/m$^3$ or $2\times10^{14}$ N/m$^3$. Polyethylene tape or film with a combination of high strength and low thickness relative to tape or film described in the prior art advantageously results in improved antiballistic performance from multilayered material sheets produced therefrom.

Drawing, preferably uniaxial drawing, of the produced films may be carried out by means known in the art. Such means comprise extrusion stretching and tensile stretching on suitable drawing units. To attain increased mechanical strength and stiffness, drawing may be carried out in multiple steps. In case of the preferred ultra high molecular weight polyethylene films, drawing is typically carried out uniaxially in a number of drawing steps. The first drawing step may for instance comprise drawing to a stretch factor of 3. Multiple drawing may typically result in a stretch factor of 9 for drawing temperatures up to 120° C., a stretch factor of 25 for drawing temperatures up to 140° C., and a stretch factor of 50 for drawing temperatures up to and above 150° C. By multiple drawing at increasing temperatures, stretch factors of about 50 and more may be reached. This results in high strength tapes, whereby for tapes of ultra high molecular weight polyethylene, the claimed strength range of 1.2 GPa to 3 GPa and more may easily be obtained.

The resulting drawn tapes may be used as such to produce a monolayer, or they may be cut to their desired width, or split along the direction of drawing. The width of the thus produced unidirectional tapes is only limited by the width of the film from which they are produced. The width of the tapes preferably is more than 2 mm, more preferably more than 5 mm and most preferably more than 30 mm. The areal density of the tapes or monolayers can be varied over a large range, for instance between 3 and 200 g/m$^2$. Preferred areal density of the tapes or monolayers ranges between 5 and 120 g/m$^2$, more preferred between 5 and 50 g/m$^2$ and most preferred between 3 and 25 g/m$^2$. The thickness of the tapes or monolayers can also be varied over a large range, for instance between 3 and 200 μm. Preferred thicknesses of the tapes or monolayers range between 5 and 120 μm, more preferred between 5 and 50 μm, more preferred between 5 and 29 μm and most preferred between 5 and 25 μm. In another embodiment of the present invention, the preferred thickness of the tapes or monolayers are at least 10 μm, but less than 50, 29 or 25 μm.

The strength of the tapes or monolayers may also be varied over a wide range, provided the combination of strength and thickness satisfies the claimed relation between the two parameters. A preferred material sheet is characterized in that the strength of at least one monolayer is larger than 1.5 GPa, even more preferred larger than 1.8 GPa, even more preferred larger than 2.5 GPa, and most preferred larger than 4 GPa.

A preferred multilayered material sheet according to the present invention comprises a consolidated stack of unidirectional monolayers of drawn polymer, whereby the draw direction of two subsequent monolayers in the stack differs, whereby at least one monolayer comprises at least one unidirectional tape of the drawn polymer, each tape comprises longitudinal edges, whereby the monolayer is free of an area of elevated thickness adjacent to and along the substantial length of the longitudinal edges.

Another preferred multilayered material sheet according to the invention is characterized in that at least one monolayer comprises a plurality of unidirectional tapes of the drawn polyolefine, aligned in the same direction, whereby adjacent tapes do not overlap.

This provides a multilayered material sheet with much simpler construction than the construction disclosed in EP 1627719 A1. Indeed the multilayer material disclosed in EP 1627719 A1 is produced by positioning a plurality of tapes of ultrahigh molecular weight polyethylene adjacent to each other whereby the tapes overlap over some contact area of their edges. Preferably this area is additionally covered with polymeric film. The multilayer material of the present preferred embodiment does not require this elaborate construction for good antiballistic performance.

Another particularly preferred multilayer material sheet according to the invention comprises at least one monolayer, preferably all monolayers, built up of a plurality of unidirectional tapes of the drawn polymer, aligned such that they form a woven structure. Such tapes may be manufactured by applying textile techniques, such as weaving, braiding, etc. of small strips of drawn ultra high molecular weight polyolefine and ultra high molecular weight polyethylene in particular. The strips have the same thickness and strength values as required by the invention. They may be fixated by stitching with thin yarns and/or other light weight means.

The multilayer material sheet according to the invention preferably comprises at least 2 unidirectional monolayers, preferably at least 4 unidirectional monolayers, more preferably at least 6 unidirectional monolayers, even more preferably at least 8 unidirectional monolayers and most preferably at least 10 unidirectional monolayers. Increasing the number of unidirectional monolayers in the multilayer material sheet of the invention simplifies the manufacture of articles form these material sheets, for instance antiballistic plates. Flexible antiballistic garments may advantageously be prepared by stacking between 4 and 8 monolayers according to the invention.

The invention also relates to a process for the preparation of a multilayered material sheet of the claimed type. The process according to the invention comprises the steps of:

(a) providing a plurality of drawn ultra high molecular weight polyethylene tapes according to the invention, aligned such that each tape is oriented in parallel to adjacent tapes, and whereby adjacent tapes may partially overlap;

(b) positioning said plurality of drawn ultra high molecular weight polyethylene tapes onto a substrate thereby forming a first monolayer;

(c) positioning a plurality of drawn ultra high molecular weight polyethylene tapes according to the invention onto the first monolayer, thus forming a second monolayer, whereby the direction of the second monolayer makes an angle $\alpha$ with respect to the first; and (d) compressing the thus formed stack at an elevated temperature to consolidate the monolayers thereof.

By compressing the unidirectional monolayers they are sufficiently interconnected to each other, meaning that the unidirectional monolayers do not delaminate under normal use conditions such as e.g. at room temperature. With the claimed process, a multilayered material sheet having monolayers of the required thickness and strength may readily be produced. A particularly preferred method comprises aligning the plurality of drawn ultra high molecular weight polyethylene tapes such that each tape is oriented in parallel to adjacent tapes, and whereby adjacent tapes do not overlap. Overlaps create regions of higher thickness in the stack, which leads to areas of high pressure when consolidating the stack in step d). This is prevented in the preferred embodiment of the method, which leads to a better antiballistic performance.

The multilayer material sheet according to the invention is particularly useful in manufacturing ballistic resistant articles, such as vests or armoured plates. Ballistic applications comprise applications with ballistic threat against projectiles of several kinds including against armor piercing, so-called AP bullets, improvised explosive devices and hard particles such as e.g. fragments and shrapnel.

The ballistic resistant article according to the invention comprises at least 2 unidirectional monolayers, preferably at least 10 unidirectional monolayers, more preferably at least 20 unidirectional monolayers, even more preferably at least 40 unidirectional monolayers and most preferably at least 80 unidirectional monolayers. The draw direction of two subsequent monolayers in the stack differs by an angle of $\alpha$. The angle $\alpha$ is preferably between 45 and 135°, more preferably between 65 and 115° and most preferably between 80 and 100°.

Preferably the ballistic resistant article according to the invention comprises a further sheet of inorganic material selected from the group consisting of ceramic, metal, preferably steel, aluminium, magnesium titanium, nickel, chromium and iron or their alloys, glass and graphite, or combinations thereof. Particularly preferred is metal. In such case the metal in the metal sheet preferably has a melting point of at least 350° C., more preferably at least 500° C., most preferably at least 600° C. Suitable metals include aluminum, magnesium, titanium, copper, nickel, chromium, beryllium, iron and copper including their alloys as e.g. steel and stainless steel and alloys of aluminum with magnesium (so-called aluminum 5000 series), and alloys of aluminum with zinc and magnesium or with zinc, magnesium and copper (so-called aluminum 7000 series). In said alloys the amount of e.g. aluminum, magnesium, titanium and iron preferably is at least 50 wt %. Preferred metal sheets comprising aluminum, magnesium, titanium, nickel, chromium, beryllium, iron including their alloys. More preferably the metal sheet is based on aluminum, magnesium, titanium, nickel, chromium, iron and their alloys. This results in a light antiballistic article with a good durability. Even more preferably the iron and its alloys in the metal sheet have a Brinell hardness of at least 500. Most preferably the metal sheet is based on aluminum, magnesium, titanium, and their alloys. This results in the lightest antiballistic article with the highest durability. Durability in this application means the lifetime of a composite under conditions of exposure to heat, moisture, light and UV radiation. Although the further sheet of material may be positioned anywhere in the stack of monolayers, the preferred ballistic resistant article is characterized in that the further sheet of material is positioned at the outside of the stack of monolayers, most preferably at least at the strike face thereof.

The ballistic resistant article according to the invention preferably comprises a further sheet of the above described inorganic material having a thickness of at most 100 mm. Preferably the maximum thickness of the further sheet of inorganic material is 75 mm, more preferably 50 mm, and most preferably 25 mm. This results in the best balance between weight and antiballistic properties. Preferably in the event that the further sheet of inorganic material is a metal sheet, the thickness of the further sheet, preferably a metal sheet, is at least 0.25 mm, more preferably at least 0.5 mm, and most preferably at least 0.75 mm. This results in even better antiballistic performance.

The further sheet of inorganic material may optionally be pre-treated in order to improve adhesion with the multilayer material sheet. Suitable pre-treatment of the further sheet includes mechanical treatment e.g. roughening or cleaning the surface thereof by sanding or grinding, chemical etching with e.g. nitric acid and laminating with polyethylene film.

In another embodiment of the ballistic resistant article a bonding layer, e.g. an adhesive, may be applied between the further sheet and the multilayer material sheet. Such adhesive may comprise an epoxy resin, a polyester resin, a polyurethane resin or a vinylester resin. In another preferred embodiment, the bonding layer may further comprise a woven or non woven layer of inorganic fiber, for instance glass fiber or carbon fiber. It is also possible to attach the further sheet to the multilayer material sheet by mechanical means, such as e.g. screws, bolts and snap fits. The bonding layer preferably has a relatively low weight, preferably at most 30%, more preferred at most 20%, even more preferred at most 10%, and most preferred at most 5% of the total weight of the article. In the event that the ballistic resistant article according to the invention is used in ballistic applications where a threat against AP bullets may be encountered the further sheet preferably comprises a metal sheet covered with a ceramic layer. In this way an antiballistic article is obtained with a layered structure as follows: ceramic layer/metal sheet/at least two unidirectional sheets with the direction of the fibers in the unidirectional sheet at an angle $\alpha$ to the direction of the fibers in an adjacent unidirectional sheet. Suitable ceramic materials include e.g. alumina oxide, titanium oxide, silicium oxide, silicium carbide and boron carbide. The thickness of the ceramic layer depends on the level of ballistic threat but generally varies between 2 mm and 30 mm. This ballistic resistant article is preferably positioned such that the ceramic layer faces the ballistic threat. This gives the best protection against AP bullets and hard fragments.

The invention also relates to a process for the manufacture of a ballistic resistant article comprising the steps of:

(a) stacking at least a multilayered material sheet according to the invention and a further sheet of inorganic material selected from the group consisting of ceramic, steel, aluminum, titanium, glass and graphite, or combinations thereof; and (b) consolidating the stacked sheets under temperature and pressure.

A preferred process for the manufacture of a ballistic resistant article comprises the steps of:

(a) stacking at least a multilayered material sheet comprising a consolidated stack of unidirectional monolayers of drawn ultra high molecular weight polyolefine, whereby the draw direction of two subsequent monolayers in the stack differs, whereby the strength to thickness ratio of at least one monolayer is larger than $4.5.10^{13}$ N/m$^3$, and a further sheet of material selected from the group consisting of ceramic, steel, aluminum, titanium, glass and graphite, or combinations thereof; and (b) consolidating the stacked sheets under temperature and pressure.

Consolidation for all processes described above may suitably be done in a hydraulic press. Consolidation is intended to mean that the monolayers are relatively firmly attached to one another to form one unit. The temperature during consolidating generally is controlled through the temperature of the press. A minimum temperature generally is chosen such that a reasonable speed of consolidation is obtained. In this respect 80° C. is a suitable lower temperature limit, preferably this lower limit is at least 100° C., more preferably at least 120° C., most preferably at least 140° C. A maximum temperature is chosen below the temperature at which the drawn polymer monolayers lose their high mechanical properties due to e.g. melting. Preferably the temperature is at least 5° C., more preferably at least 18° C. and even more preferably at least 15° C. below the melting temperature of the drawn polymer monolayer. In case the drawn polymer monolayer does not exhibit a clear melting temperature, the temperature at which the drawn polymer monolayer starts to lose its mechanical properties should be read instead of melting temperature. In the case of the preferred ultra high molecular weight polyethylene, a temperature below 149° C., preferably below 147° C. generally will be chosen. The pressure during consolidating preferably is at least 7 MPa, more preferably at least 15 MPa, even more preferably at least 20 MPa and most preferably at least 35 MPa. In this way a stiff antiballistic article is obtained. The optimum time for consolidation generally ranges from 5 to 120 minutes, depending on conditions such as temperature, pressure and part thickness and can be verified through routine experimentation. In the event that curved antiballistic articles are to be produced it may be advantageous to first pre-shape the further sheet of material into the desired shape, followed by consolidating with the monolayers and/or multilayer material sheet.

Preferably, in order to attain a high ballistic resistance, cooling after compression moulding at high temperature is carried out under pressure as well. Pressure is preferably maintained at least until the temperature is sufficiently low to prevent relaxation. This temperature can be established by one skilled in the art. When a ballistic resistant article comprising monolayers of ultra high molecular weight polyethylene is manufactured, typical compression temperatures range from 90 to 153° C., preferably from 115 to 130° C. Typical compression pressures range between 100 to 300 bar, preferably 120 to 160 bar, whereas compression times are typically between 40 to 180 minutes.

The multilayered material sheet and antiballistic article of the present invention are particularly advantageous over previously known antiballistic materials as they provide an improved level of protection as the known articles at a low weight. Besides ballistic resistance, properties include for instance heat stability, shelf-life, deformation resistance, bonding capacity to other material sheets, formability, and so on.

Test methods as referred to in the present application, are (unless otherwise indicated) as follows Intrinsic Viscosity (IV) is determined according to method PTC-179 (Hercules Inc. Rev. Apr. 29, 1982) at 135° C. in decalin, the dissolution time being 16 hours, with DBPC as anti-oxidant in an amount of 2 g/l solution, by extrapolating the viscosity as measured at different concentrations to zero concentration;

Tensile properties (measured at 25° C.): tensile strength (or strength), tensile modulus (or modulus) and elongation at break (or eab) are defined and determined on multifilament yarns as specified in ASTM D885M, using a nominal gauge length of the fiber of 500 mm, a crosshead speed of 50%/min. On the basis of the measured stress-strain curve the modulus is determined as the gradient between 0.3 and 1% strain. For calculation of the modulus and strength, the tensile forces measured are divided by the titre, as determined by weighing 10 meters of fiber; values in GPa are calculated assuming a density of 0.97 g/cm$^3$. Tensile properties of thin films were measured in accordance with ISO 1184(H).

EXAMPLES

Examples 1 & 2—Production of Tape

An ultrahigh molecular weight polyethylene (UHMWPE) with an intrinsic viscosity of 20 was mixed to become a (7 wt %) suspension with decalin. The suspension was fed to an extruder and mixed at a temperature of 170° C. to produce a homogeneous gel. The gel was then fed through a slot die with a width of 600 mm and a thickness of 800 μm. After being extruded through the slot die, the gel was quenched in a water bath, thus creating a gel-tape. The gel tape was stretched by a factor of 3.85 after which the tape was dried in an oven consisting of two parts at 50° C. and 80° C. until the amount of decalin was below 1%. This dry gel tape was wound on a coil for later treatment.

The later treatment consisted of two stretching steps. The first stretching step was performed with a length of 20 meter tape in an oven at 140° C., with a stretching ratio of 5.8. The tape was reeled up and fed through an oven again. The second stretching step was performed at an oven temperature of 150° C. to achieve an additional stretching ratio of 6. The resulting tape had a width of 20 mm and a thickness of 12 micron.

Performance Testing of the Tape

The tensile properties of the tapes were tested by twisting the tape at a frequency of 38 twists/meter to form a narrow structure that is tested as for a normal yarn. Further testing was in accordance with ASTM D885M, using a nominal gauge length of the fiber of 500 mm, a crosshead speed of 50%/min and Instron 2714 clamps, of type Fiber Grip D5618C.

Examples 1 & 2—Production of Armor Panels from the Tape

A first layer of tapes was placed, with parallel tapes adjacent to each other. A second layer of adjacent parallel tapes was placed on top of the first layer, whereas the tapes of the second layer were perpendicular to the tapes of the first layer. Subsequently, a third layer was placed on top of the second layer, again perpendicular to that second layer. The third layer was placed with a small shift (about 5 mm) as compared to the first layer. The shift was a half tape width. This shift was applied to minimize a possible accumulation of tape edges at a certain location. A forth layer was placed perpendicular to the third layer, with a small shift as compared to the second layer. The procedure was repeated until an areal density (AD) of 2.57 kg/m$^2$ was reached. The stacks of layered tapes were moved into a press and pressed at a temperature of 145° C. and a pressure of 300 Bar for 65 minutes. Cooling was performed under pressure until a temperature of 80° C. was reached. No bonding agent was applied to the tapes. Nevertheless, the stacks had been fused to a rigid homogeneous 800×400 mm plate.

Performance Testing of the Armoured Panels

The armoured plates were subjected to shooting tests performed with 9 mm parabellum bullets (Example 1) or 17 grain (1.1 gram) Fragment Simulating Projectiles (FSP: Example 2). Both tests were performed with the aim of determining a V50 and/or the energy absorbed (E-abs). V50 is the speed at which 50% of the projectiles will penetrate the armoured plate. The testing procedure was as follows. The first projectile was fired at the anticipated V50 speed. The actual speed was measured shortly before impact. If the projectile was stopped, a next projectile was fired at an intended speed of about 10% higher. If it perforated, the next projectile was fired at an intended speed of about 10% lower. The actual speed of impact was always measured. This procedure was repeated until at least 2 stops and 2 perforations were obtained. V50 was the average of the two highest stops and the two lowest perforations. The performance of the armour was also determined by calculating the kinetic energy of the projectile at V50 and dividing this by the AD of the plate (E-abs).

Results:

| Example; Compar. Exp. | Projectile | V50 m/s | E-abs J/(kg/m$^2$) | Thickness μm | Strength GPa | Strength/Thickness (×10$^{13}$) N/m$^3$ |
|---|---|---|---|---|---|---|
| 1 | 9 mm parabellum | 563 | 498 | 12 | 2.5 | 21 |
| 2 | 17 grain FSP | | 64 | 12 | 2.5 | 21 |
| A | 9 mm parabellum | — | 250 | 65 | 2.8 | 4.3 |
| B | 17 grain FSP | — | 31 | 65 | 2.8 | 4.3 |

Comparative experiments A, B were performed on sheets formed from commercially available ultrahigh molecular weight polyethylene (UHMWPE) unidirectional fiber. The fibers were impregnated and bonded together with 20 wt % of a thermoplastic polymer. The strength of the monolayers in comparative experiments A, B was 2.8 GPa, which is the strength of the fibers times the fiber content in the monolayer. The monolayers of the comparative experiments were compressed at about 125° C. under 165 bar pressure for 65 minutes to produce a sheet with the required areal density. The thickness of the monolayers after compressing was 65 micron.

The results confirm that a multilayered material sheet with a strength to monolayer thickness ratio of greater than 4.5×10$^{13}$ N/m$^3$ exhibits improved antiballistic performance compared to multilayered material sheets of the prior art. In particular, the multilayered material sheet of the present invention produces an E-abs values of about twice as much as comparative samples from the prior art.

The invention claimed is:

1. A ballistic resistant article comprising a multilayered material sheet comprising:

a consolidated stack of multiple unidirectional film monolayers comprised of a plurality of drawn anti-ballistic polymer film tapes having a stretch factor of at least 9 and a tensile strength of at least about 1.2 GPa, wherein adjacent monolayers in the stack have respective draw directions which differ from one another, and wherein the film tapes in the stack have an areal density of from 5 g/m$^2$ to less than 50 g/m$^2$ and a strength to thickness ratio which is larger than 4.5×10$^{13}$ N/m$^3$.

2. The ballistic resistant article according to claim 1, wherein the film tapes or monolayers have a strength to thickness ratio which is larger than 7×10$^{13}$ N/m$^3$.

3. The ballistic resistant article according to claim 1, which comprises a binder.

4. The ballistic resistant article according to claim 1, wherein the thickness of the film monolayers is between 3 and 25 μm.

5. The ballistic resistant article according to claim 4, wherein the tensile strength of the drawn film tapes in the film monolayers is at least about 4 GPa.

6. The ballistic resistant article according to claim 1, wherein the polymer comprises ultra high molecular weight polyethylene.

7. The ballistic resistant article according to claim 1, wherein the draw directions of the adjacent monolayers in the stack differ by an angle α of between 45 and 135°.

8. The ballistic resistant article according to claim 1, wherein adjacent drawn film tapes in the film monolayers do not overlap.

9. The ballistic resistant article according to claim 1, wherein at least one of the film monolayers comprises a plurality of woven unidirectional film tapes of the drawn polymer.

10. The ballistic resistant article according to claim 1, comprising at least 4 unidirectional monolayers.

11. The ballistic resistant article according to claim 1, comprising a further sheet of material selected from the group consisting of ceramic, steel, aluminum, magnesium titanium, nickel, chromium and iron or their alloys, glass and graphite, or combinations thereof.

12. The ballistic resistant article according to claim 11, wherein the further sheet of material is positioned at an outside of the stack of monolayers at least at a strike face thereof.

13. The ballistic resistant article according to claim 11, wherein the further sheet of inorganic material has a thickness which is at most 50 mm.

14. The ballistic resistant article according to claim 11, further comprising a bonding layer between the material sheet and the further sheet of material, wherein the bonding layer comprises a woven or non-woven layer of inorganic fibers.

15. The ballistic resistant article according to claim 1, wherein the drawn anti-ballistic polymer film tapes have a stretch factor of at least 25.

16. The ballistic resistant article according to claim 7, wherein the angle α is between 80 and 100°.

17. The ballistic resistant article according to claim 1, wherein the ballistic resistant article has an E-abs ballistic performance value which is at least twice the E-abs ballistic performance value of an identical comparative ballistic resistant article of the same areal density but having monolayers in the stack with a strength to thickness ratio lower than $4.5\times10^{13}$ N/m$^3$ determined after two stops and two penetrations of the articles with 9 mm parabellum projectiles and 17 grain fragment simulating projectiles (FSP).

18. The ballistic resistant article according to claim 1, wherein the ballistic resistant article has an E-abs ballistic performance value which is at least twice the E-abs ballistic performance value of an identical comparative ballistic resistant article of the same areal density but having film tapes in the stack which have an areal density of greater than 50 g/m$^2$ determined after two stops and two penetrations of the articles with 9 mm parabellum projectiles and 17 grain fragment simulating projectiles (FSP).

19. The ballistic resistant article according to claim 1, wherein the film tapes in the stack have an areal density of less than 29 g/m$^2$.

20. The ballistic resistant article according to claim 1, wherein the film tapes in the stack have an areal density of less than 25 g/m$^2$.

21. A process for the manufacture of a ballistic resistant article according to claim 1 comprising:

(a) stacking the multilayered material sheet and a sheet of material selected from the group consisting of ceramic, steel, aluminum, titanium, glass and graphite, or combinations thereof; and (b) consolidating the stacked sheets under temperature and pressure.

* * * * *